US006893385B2

(12) United States Patent
Smithberg

(10) Patent No.: US 6,893,385 B2
(45) Date of Patent: May 17, 2005

(54) PROTECTIVE DISK FOR DUMBBELL WEIGHTS

(76) Inventor: Christopher J. Smithberg, 1651 S. Grape St., Denver, CO (US) 80222

( * ) Notice: Subject to any disclaimer, the term of this patent is extended or adjusted under 35 U.S.C. 154(b) by 423 days.

(21) Appl. No.: 10/084,396

(22) Filed: Feb. 27, 2002

(65) Prior Publication Data

US 2003/0162637 A1 Aug. 28, 2003

(51) Int. Cl.[7] ..... A63B 21/06
(52) U.S. Cl. ..... 482/93; 482/107
(58) Field of Search ..... 482/92, 93, 104, 482/106–108; D21/680, 681

(56) References Cited

U.S. PATENT DOCUMENTS

| | | | | |
|---|---|---|---|---|
| 1,326,013 A | | 12/1919 | Ayd | |
| 2,470,815 A | * | 5/1949 | Harvey | 482/106 |
| 2,821,394 A | | 1/1958 | Barbeau | |
| 3,771,785 A | | 11/1973 | Speyer | |
| D230,752 S | | 3/1974 | Speyer | |
| 3,913,908 A | * | 10/1975 | Speyer | 482/106 |
| D279,495 S | | 7/1985 | Barbeau | |
| 5,203,753 A | | 4/1993 | Rothhammer | |
| 5,221,244 A | | 6/1993 | Doss | |
| 5,250,014 A | | 10/1993 | Chang | |
| 5,415,607 A | | 5/1995 | Carpenter | |
| 5,536,227 A | * | 7/1996 | Polchek et al. | 482/93 |
| D415,803 S | | 10/1999 | Cousins | |
| 6,224,520 B1 | | 5/2001 | Hsu | |
| 6,261,211 B1 | * | 7/2001 | Suarez et al. | 482/107 |

FOREIGN PATENT DOCUMENTS

| | | | | |
|---|---|---|---|---|
| GB | 2 159 061 A | | 11/1985 | |
| GB | 2159061 A | * | 11/1985 | A63B/11/02 |

* cited by examiner

*Primary Examiner*—Danton D. DeMille
*Assistant Examiner*—Tam Nguyen
(74) *Attorney, Agent, or Firm*—Thomte, Mazour & Niebergall; Shane M. Niebergall

(57) ABSTRACT

A disk to be installed on a dumbbell around the middle bar and adjacent the weight at one end to protect the user's hand(s) from contact with the weight. A slot allows the disk to be installed without removing the weights. A cavity on the weight side of the disk provides clearance for the shoulder or collar which hold the weights in position on some dumbbells. The inner surface of the disk is convex while the outer is generally planar to lie flat against the weights.

18 Claims, 4 Drawing Sheets

PROTECTIVE DISK FOR DUMBBELL WEIGHTS

BACKGROUND OF THE INVENTION

1. Field of the invention

The present invention relates to the field of weight lifting apparatus and specifically to devices intended to protect or cushion the user's hands from the weights.

2. Background Information

Weight training uses a wide variety of equipment and devices to provide resistance. While machines in various configurations have become popular, barbells and dumbbells remain essential equipment. Dumbbells are especially popular due to the adaptability with which they can be used for a variety of exercises.

While the dumbbell is designed to be gripped with the bar essentially horizontal, certain weightlifting exercises require that the dumbbell be held with the bar in a substantially vertical position. Examples of such exercises include pullovers and hammer curls. With the dumbbell held in this position, the bar will typically slip through the users hand unless gripped very tightly. Such a grip is counter productive and still may not succeed in maintaining the position of the dumbbell. As a result, the dumbbell is most often held with the weights bearing against the side of the users hand or with the hands cupping the weights.

Either of the above positions can result in discomfort for the user. Where a dumbbell with interchangeable weight plates is used, there is typically a shoulder or collar at the juncture of the weight plate and the bar. This shoulder or collar creates a protruding ridge at the point where the user's hand would contact the weight plate with the dumbbell held vertically. This can be avoided by cupping the weights, but this approach has its own problems. Typically, the weight, or weight plates, are flat on the inner surface. The user's cupped hands form a generally concave shape. The result is that only the outer edges of the user's hands bear on the weight plate. Where dumbbells of fixed weight are used, the designers have more liberty to contour the shape of the weight portion. Even here, though, the shape is seldom optimal for the type of exercise addressed above.

Because of the relatively compact dimensions of dumbbells, there is usually little room to spare in the area between the weights where the bar is gripped. This factor, combined with the fact that the dumbbells are used for a variety of exercises, means that a permanent fixture, or pad, would not generally be an acceptable solution.

There is a need for a disk, or pad, which can be attached to a dumbbell when it is used for those exercises requiring a vertical alignment of the bar. This pad should be at least slightly resilient to provide padding. Ideally, the disk would present a convex surface which at least somewhat approximates the concave surface formed by the hands of a user cupping the weight which is at the end of a dumbbell. Preferably the disk should be easily removable to eliminate interference when not needed and so that the user can install and remove the disk at will, especially where using a shared set of dumbbells.

BRIEF SUMMARY OF THE INVENTION

The present invention is directed to a device which can be placed around the bar of a dumbbell between the weights and a users hand(s) to provide a level of protection and comfort to the user.

According to the invention there is provided a disk having a generally flat, or planar, surface intended to bear against the weights and a convex surface intended for contact with the users hands. A central hole, perpendicular to these surfaces is sized to receive the bar of the dumbbell.

According to an aspect of the invention a slot connects the central hole to the outer rim of the disk, allowing the disk to be placed around the bar without the need to remove the weights. Preferably, this slot is smaller than the hole so that the disk will be retained in position on the bar after installation.

According to another aspect of the invention the inner surface is relatively smooth with an optional texturing for improved grip.

Further in accordance with the invention the structure of the disk uses alternating ribs and gaps open to the outer surface.

The advantages of such an apparatus are that a dumbbell fitted with such a device may be comfortably used in a vertical position with the user's hand supporting the weight rather than the dumbbell. The convex surface is adaptable to both a normal grip on the bar and a cupped grip of the weight itself. Where the slot is provided the disk is easily removed when not needed.

The above and other features and advantages of the present invention will become more clear from the detailed description of a specific illustrative embodiment thereof, presented below in conjunction with the accompanying drawings.

DETAILED DESCRIPTION OF THE INVENTION

The following discussion focuses on the preferred embodiment of the invention, used with a dumbbell having removable weights. However, as will be recognized by those skilled in the art, the disclosed method and apparatus are applicable to a wide variety of situations in which padding or protection for any dumbbell or similar device is desired.

Glossary

The following is a brief glossary of terms used herein. The supplied definitions are applicable throughout this specification and the claims unless the term is clearly used in another manner.

Inner—generally with respect to the dumbbell. Thus inner would be toward the middle and toward the users hand(s).

Outer—generally with respect to the dumbbell. Thus outer would be toward the end and toward the weights.

Preferred Embodiment

The disclosed invention is described below with reference to the accompanying figures in which like reference numbers designate like parts. Generally, numbers in the 200's refer to prior art elements or elements in the surrounding environment while numbers in the 100's refer to elements of the invention.

Figure 1:
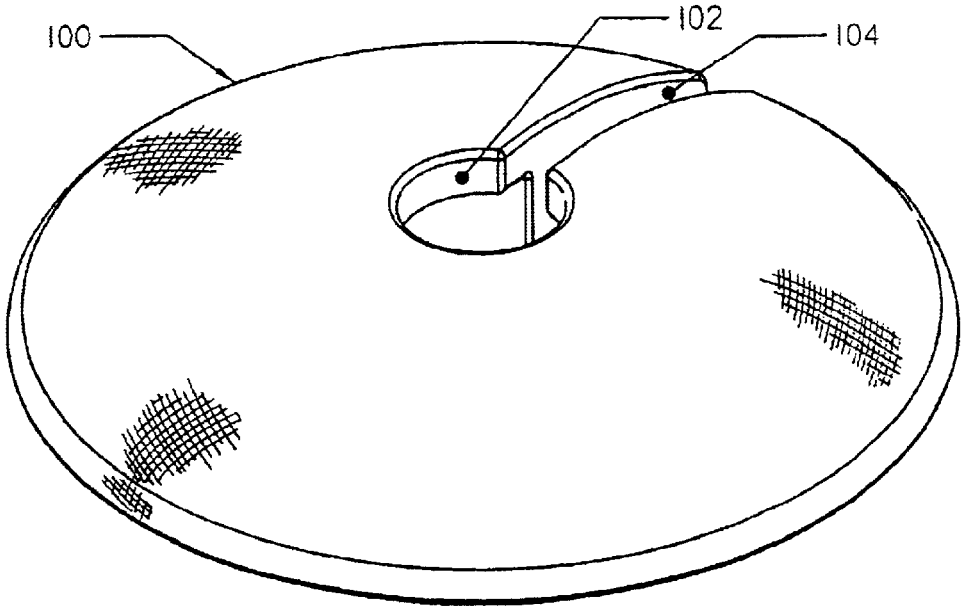
FIG. 1 is a perspective view showing the inner surface of the disk which would contact the user's hand(s).
Figure 2:
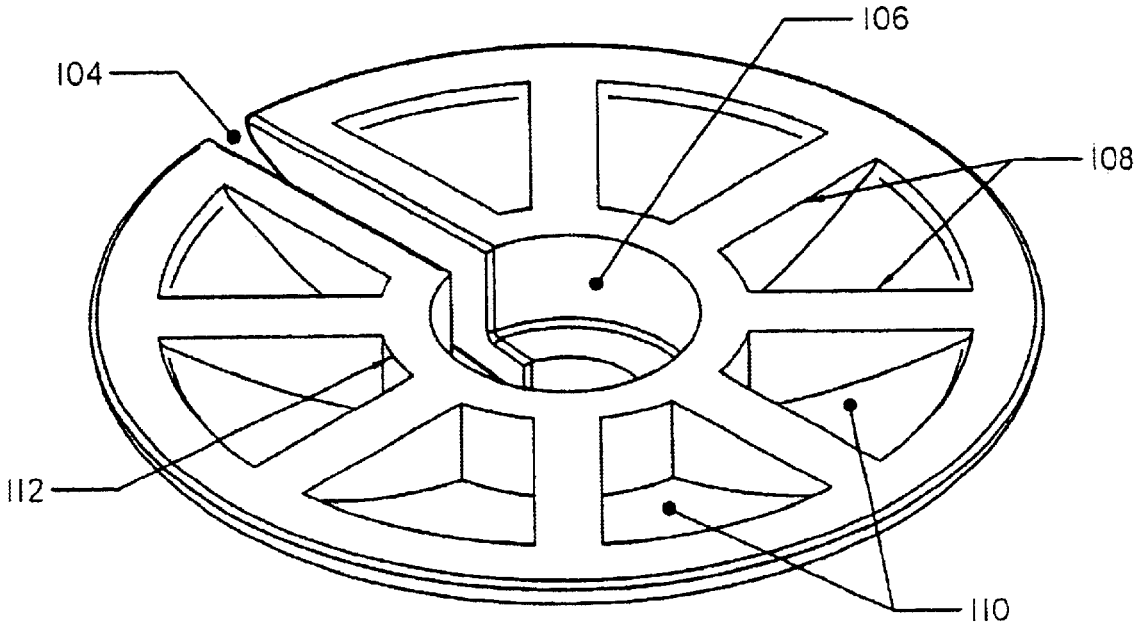
FIG. 2 is a perspective view showing the outer surface of the disk which would bear against the weight.
Figure 3:
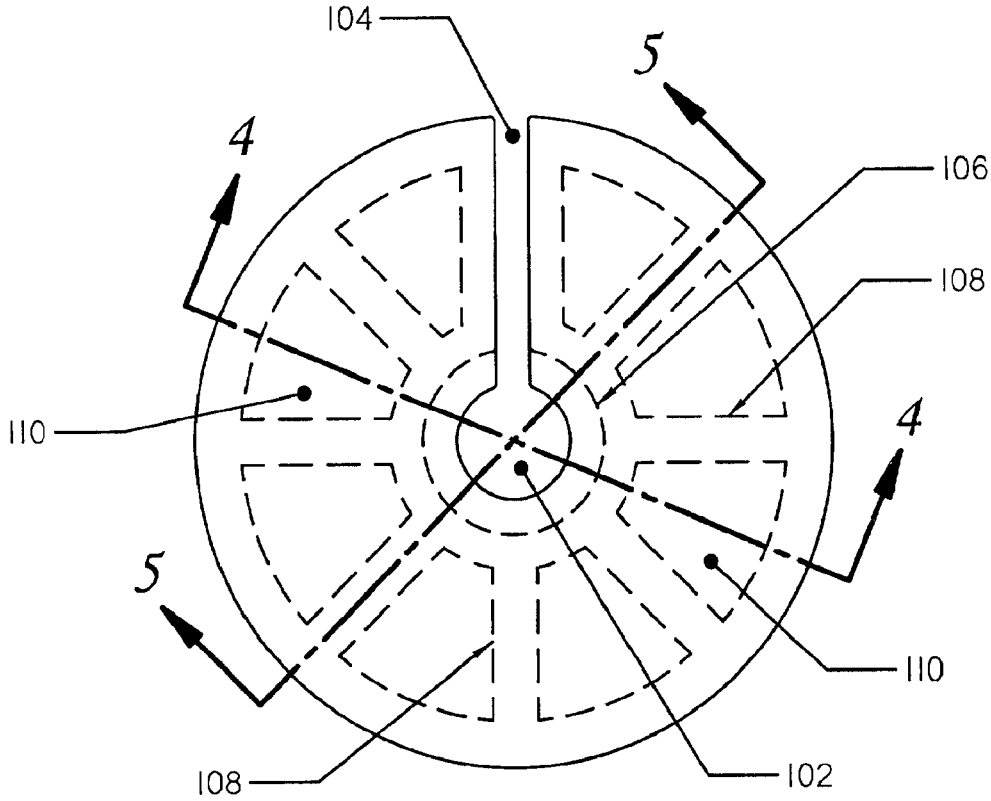
FIG. 3 is a plan view of the inner surface.
Figure 4:
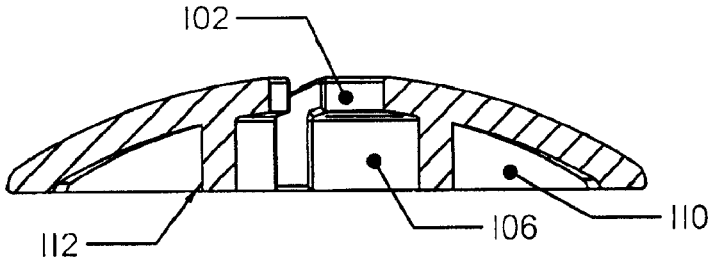
FIG. 4 is a cross section through the gaps in the structure of the disk.
Figure 5:
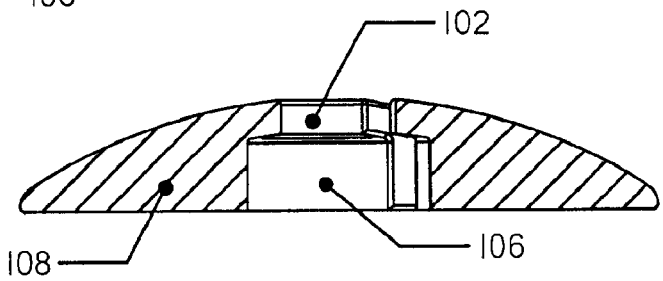
FIG. 5 is a cross section through the ribs in the structure of the disk.

FIGS. 1 and 2 provide a perspective view of the inner (toward the user's hand) and outer (toward the weights) surfaces of the inventive disk, respectively. While the appearance of the disk may appear relatively straightforward, its design incorporates several features which enable it to better perform its function.

The invention is disk shaped with a flat outer surface adapted to bear against the weights and a convex inner surface adapted to contact the user's hands. See also FIGS. 7 and 8. Note that the contour of the outer surface could be modified to adapt to weights having a different profile than those illustrated. In the preferred embodiment, the inner surface has a radius of curvature of approximately 6.3 inches. Clearly this radius could be altered to adapt the disk for different applications. A smaller radius would provide a rounder shape and a thicker disk which may be preferred where the disk is used primarily with cupped hands or greater weights. However, such a contour would occupy significantly more of the limited space available to the users hands. Depending on the relative size of the user's hands and of the dumbbell, such a configuration may or may not be desirable. The relatively gentle curve illustrated also offers the advantage of tapering to a narrow edge at the outer circumference of the disk. This effectively eliminates the edge which would exist with a simple disk-shaped pad. Such an edge would likely wear against and irritate the user's hands. If desired, the inner surface may be textured to improve the user's grip.

Hole, 102, is designed to accept the bar of the dumbbell. Such bars vary in diameter with 1 inch being typical. In the preferred embodiment the hole has a diameter of approximately 1.5 inches to accommodate the majority of bars in use. Slot, 104, connects the central hole to the outer edge of the disk. This allows the disk to be placed onto the bar without removing the weights from the dumbbell. With the disk made of a resilient material, as discussed below, both the slot and the hole can flex and expand to fit over the bar. They then return to their original dimensions to retain the disk on the bar while in use. In the preferred embodiment, the slot is approximately 0.375 inch wide which has been found to provide sufficient clearance for the bar while being substantially imperceptible to the user while in use. Overall, the preferred embodiment of the disk is approximately 7 inches in diameter and approximately 1.2 inches thick. Clearly, this could be adjusted to adapt the disk to other dumbbells and weight configurations.

Referring to FIGS. 2–5, the details of the structure of the inventive disk can be seen. Preferably the disk is formed with alternating ribs, 108, and gaps, 110, as the supporting structure for the smooth surface presented to the user. This both decreases the amount of material needed to manufacture a disk and improves the resilience of the disk. Configured as shown, the ribs are free to compress and flex under pressure, conforming to the user's hands. This more evenly distributes the pressure of the dumbbell on the user's hands, increasing the level of comfort. This design feature also allows for increased design flexibility as the thickness, and length, of the ribs can be altered during manufacture to alter the resilience of the disk. This can be used to offer different stiffnesses with the same material or to achieve a desired stiffness with different materials. Similarly the number and spacing of the ribs can be varied. Central cavity, 106, accommodates the shoulder or collar used to secure the weights in position on the bar. In the preferred embodiment, this cavity is approximately 2 inches in diameter and 0.8 inch deep. This is sufficient to accommodate the majority of dumbbell collars in use. The rim, 112, of the cavity also bears against the surface of the weights.

Figure 6:
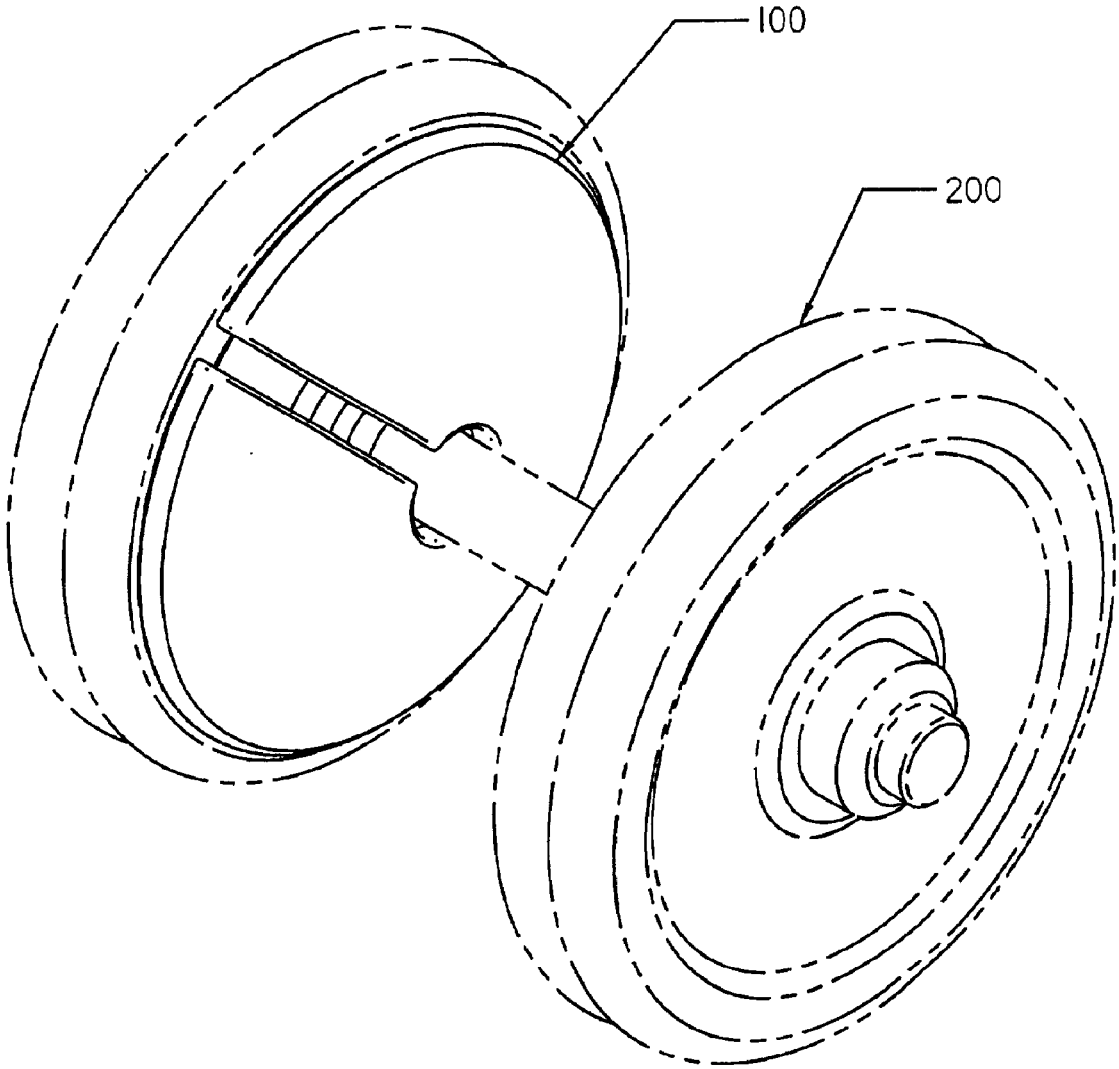
FIG. 6 is a perspective view illustrating the disk in position on a typical dumbbell.
Figure 7:
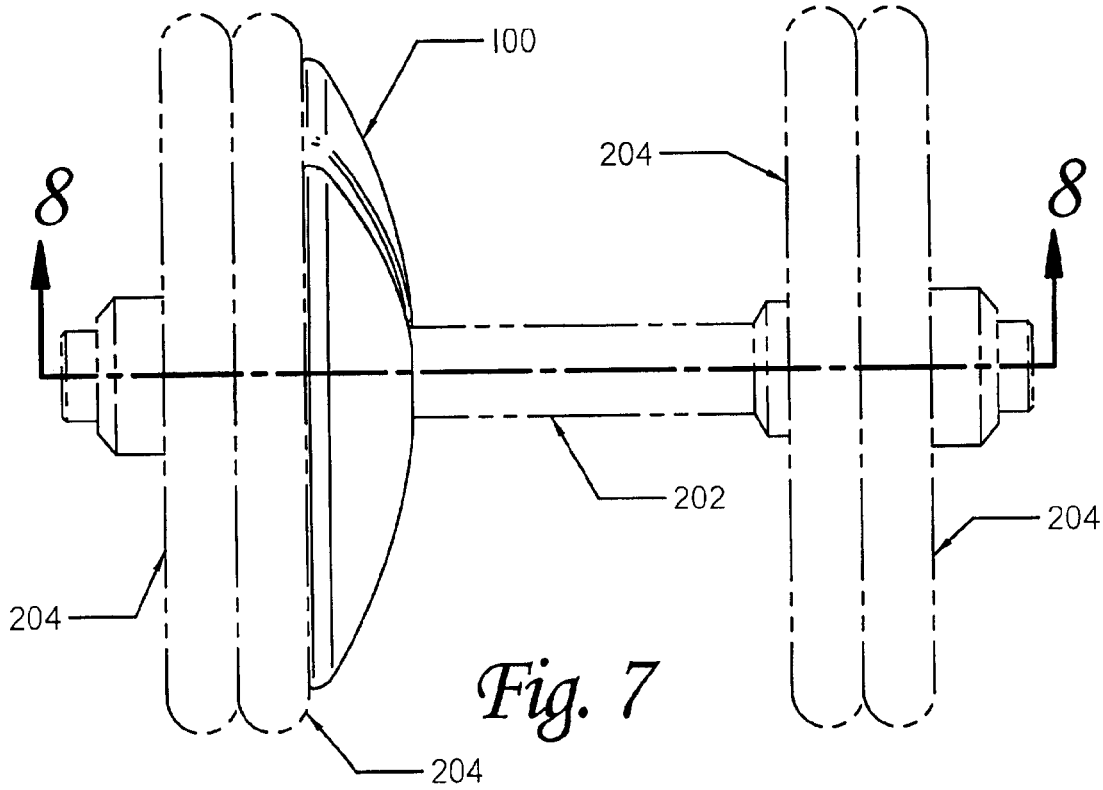
FIG. 7 is a plan view illustrating the disk in position on a typical dumbbell.
Figure 8:
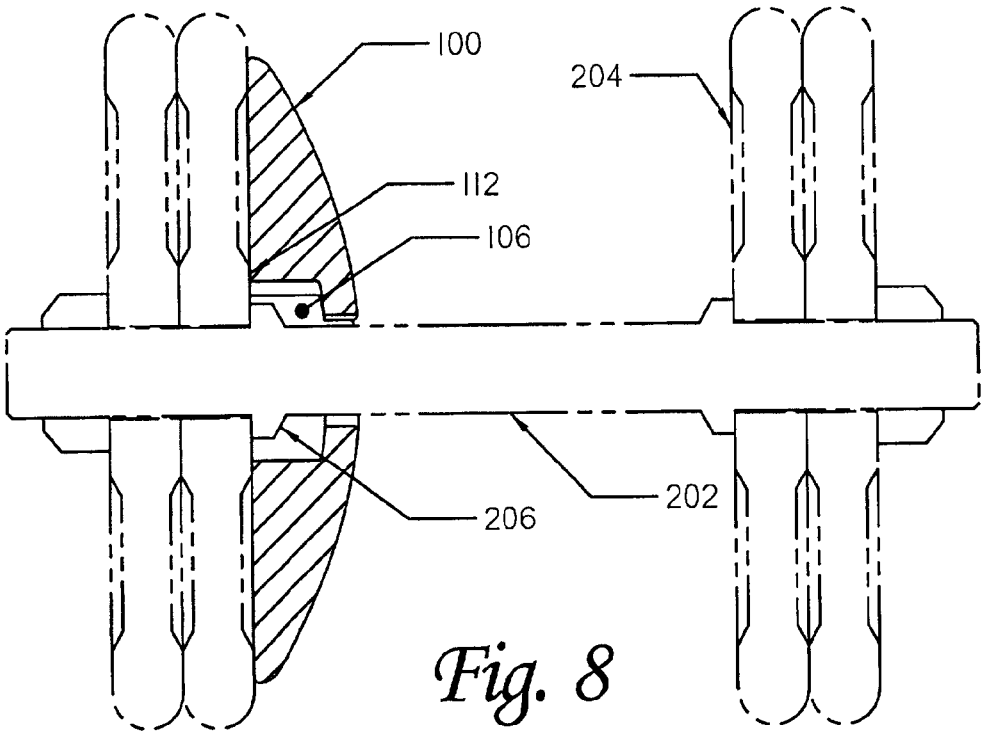
FIG. 8 is a cross section through the disk in position on a typical dumbbell.

FIGS. 6–8 illustrate the preferred embodiment of the inventive disk, 100, in position on a typical dumbbell, 200, having removable weight plates, 204. As illustrated, the disk is placed over the bar, 202, of the dumbbell with the outer surface bearing against the weight plate and the convex inner surface towards the center of the dumbbell. Cavity, 106, accommodates the shoulder, 206, in the bar with its rim, 112, also bearing against the weight plate.

Materials

The inventive disk could be made from a variety of materials which would supply the desired resiliency. It is anticipated that the disk would most likely be constructed by compression molding or injection press molding rubber or plastic such as urethane. The specific compound would be selected as well known in the art to achieve the desired durability, comfort and integrity. Different versions may be manufactured from differing materials to achieve varied resilience adapting the disk to different anticipated weight ranges with which it will be used. For relatively light weights, or where the disk is made solid rather than with the ribs and gaps of the preferred embodiment, a high density closed cell foam may be appropriate. For certain applications there may be no need for any resilience, but only the smooth, contoured inner surface. In such a case, hard plastic, or even metal could be used.

Alternative Embodiments

The following discussion presents alternative embodiments which offer various advantages in structure or functions without departing from the principles of the invention.

One alternative embodiment of the inventive disk is to eliminate the slot, 104. This would require that the weight plates be removed from the dumbbell to install or remove the disk. This may be desirable in certain applications, such as in a gym, where loss or theft of the disk may be a concern. Elimination of the slot may also increase the strength and durability of the disk.

A second alternative embodiment is to make the disk solid, eliminating the rib and gap structure of the preferred embodiment. This may simplify the molding process and would increase the density of the disk. Increased density would be desirably for use with very heavy weights or where the material, such as a closed cell foam, is relatively soft.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. A protective disk, adapted for use with a dumbbell having a bar with weights at opposite ends, said disk comprising:

(a) an outer surface adapted to bear against the dumbbell weights; and (b) a convex inner surface;

said disk defining a hole through said outer and inner surfaces adapted to receive the dumbbell bar;

said disk further defining a slot connecting said hole to the outer edge of said disk, the slot extending through the disk from the outer surface to the inner surface.

2. The protective disk of claim 1 wherein said outer surface is substantially planar.

3. The protective disk of claim 1 wherein said convex inner surface has a radius in the range of 5 to 8 inches and said disk has thickness of no more than 1.5 inches.

4. The protective disk of claim 1 wherein said slot has a width no more than one half the diameter of said hole.

5. The protective disk of claim 1 wherein said outer surface comprises alternating ribs and gaps extending radially from said hole.

6. The protective disk of claim 1 wherein said disk further defines a cavity, concentric with a larger than said hole, extending from said outer surface at least partially through said disk.

7. A protective disk, adapted for use with a dumbbell having a bar with weights at opposite ends, said disk comprising:

(a) a substantially planar outer surface adapted to bear against the dumbbell weights;

(b) a convex inner surface;

said disk having a central axis perpendicular to both said outer and inner surface and an outer rime; and said disk defining a hole, concentric with said central axis and extending completely through said disk, adapted to receive the dumbbell bar and a slot connecting said hole to said outer rim, the slot extending through the disk from the outer surface to the inner surface.

8. The protective disk of claim 7 wherein said disk further defines a cavity, concentric with a larger than said hole, extending from said outer surface partially through said disk.

9. The protective disk of claim 8 wherein said outer surface comprises alternating ribs and gaps extending radially from said hole.

10. The protective disk of claim 9 wherein said convex inner surface has a radius in the range of 5 to 8 inches and said disk has thickness of no more than 1.5 inches.

11. The protective disk of claim 10 wherein said inner surface is textured for improved grip.

12. The protective disk of claim 1 wherein said inner surface is textured for improved grip.

13. A protective disk, adapted for use with a dumbbell having a bar with weights at opposite ends, said disk comprising:

(a) an outer surface adapted to bear against the dumbbell weights; and (b) a convex inner surface;

said disk defining a hole through said outer and inner surfaces adapted to receive the dumbbell bar;

said outer surface comprising alternating ribs and gaps extending radially from said hole; said disk further defining a slot connecting said hole to the outer edge of said disk wherein the slot extends through the disk from the outer surface to the inner surface.

14. The protective disk of claim 13 wherein said outer surface is substantially planar.

15. The protective disk of claim 13 wherein said disk further defines a slot connecting said hole to the outer edge of said disk.

16. The protective disk of claim 15 wherein said slot has a width no more than one half the diameter of said hole.

17. The protective disk of claim 13 wherein said disk further defines a cavity, concentric with and larger than said hole, extending from said outer surface at least partially through said disk.

18. The protective disk of claim 13 wherein said inner surface is textured for improved grip.

* * * * *